US005307545A

United States Patent [19]

Stoltz

[11] Patent Number: 5,307,545

[45] Date of Patent: May 3, 1994

[54] CORRUGATED CARDBOARD COFFIN

[75] Inventor: Dennis J. Stoltz, Austell, Ga.

[73] Assignee: The Mead Corporation, Dayton, Ohio

[21] Appl. No.: 923,463

[22] Filed: Aug. 3, 1992

[51] Int. Cl.[5] ..... A61G 17/00

[52] U.S. Cl. ..... 27/4; 27/14; 27/16; 229/186

[58] Field of Search ..... 27/2, 4, 5, 14, 15, 27/17, 18, 19, 35; 229/186, 178, 179, 187

[56] References Cited

U.S. PATENT DOCUMENTS

| | | | |
|---|---|---|---|
| 3,073,440 | 1/1963 | Jones | 229/178 X |
| 3,511,429 | 5/1970 | Brian | 229/186 X |
| 3,904,106 | 9/1975 | Elder | 229/178 X |
| 3,927,823 | 12/1975 | Persson | 229/186 X |
| 4,156,956 | 6/1979 | Partridge et al. | 27/4 |
| 4,209,880 | 7/1980 | Lidholm | 27/4 X |
| 4,765,535 | 8/1988 | Michetti . | |
| 4,773,134 | 9/1988 | Kay | 27/14 |
| 4,944,076 | 7/1990 | Kay et al. | 27/14 |
| 4,949,900 | 8/1990 | Ballu | 229/179 X |
| 4,998,669 | 3/1991 | Karolyi . | |
| 5,111,559 | 5/1992 | Mohr et al. . | |

*Primary Examiner*—Carl D. Friedman
*Assistant Examiner*—Kien Nguyen
*Attorney, Agent, or Firm*—Needle & Rosenberg

[57] ABSTRACT

A corrugated cardboard coffin for use in cremation funeral services, comprising a body receiving portion and a lid which is telescopically mounted thereon. Two embodiments of the lid are presented, one of them being of a unitary construction and the other consisting of two sections which fit onto the top of the body receiving portion in back-to-back fashion. One of the sections can be removed to allow mourners to view the body. The present invention provides a sturdy and cosmetically appealing coffin with no corrugated cardboard fluting being visible in the erected structure.

7 Claims, 8 Drawing Sheets

CORRUGATED CARDBOARD COFFIN

BACKGROUND OF THE INVENTION

Over the years, cremations have become a large segment of the funeral business in the United States. In 1990, there were 368,000 cremations (or 17% of the deaths that occurred in the U.S.), whereas cremations accounted for only 10% of funeral services in 1980. According to the Cremation Association of North America, the figure will rise to 27% by the year 2010.

The price differential over the traditional burial method accounts for part of the increase in cremations. The present cremation involves a rental casket for the service with the body transferred to a cardboard box for the "final journey" and the placement of the ashes in an urn or container, although the casket itself may be burned. Obviously, the transfer of the body from the viewing casket to the cardboard box increases the costs to the funeral home.

The present cardboard coffins are only constructed to be functional since they are out of view of the mourners. For instance, those coffins have their fluting exposed at their formed edges and are otherwise visually unappealing to view. Therefore, a need exists for a cosmetically pleasing, yet sturdy, cardboard casket that can be used not only in the cremation itself, but also in the funeral service so as to eliminate the need for the traditional coffin (and the costs associated with the transfer of the body).

SUMMARY OF THE INVENTION

The disadvantages of the existing cardboard coffins are overcome by the present invention which provides a fully functional, yet attractive, corrugated casket formed from blanks which are folded in such a manner to simulate a conventional coffin. The present invention can be used in cremation ceremonies in lieu of the traditional wooden coffin, significantly reducing the number of times the body has to be moved.

There are two components of the casket of the present invention: a body receiving portion and a telescopically tapered cover or lid for the underlying body receiving portion. There are two embodiments of this invention but the body receiving portion in both embodiments remains the same. The first embodiment has a lid of a unitary design which completely covers the lower portion, whereas the lid of second embodiment comprises two separate portions, one of which can be removed to allow viewing of the head and upper body of the deceased during the service if preferred, while the other portion of the lid remains in place on the lower portion of the coffin. The second embodiment accomplishes the function of a traditional wooden casket which has a segmented lid, one section of which can remain in an open position.

In both embodiments, there are no "raw" edges or exposed fluting, as with conventional corrugated coffins. In the second embodiment, the portions of the lid have the same overall profile. The lengths of the two portions are the only difference between the two. Each of the lid portions includes a shaped end and an opposing flat end. When the two portions are on the body receiving portion, the flat ends are in abutting engagement with each other.

The exterior of the casket portions may have thereon any appropriate, cosmetically appealing finish, such as a wood-grain laminated appearance. The present invention also provides a superior appearance over existing paperboard coffins by having no visible corrugated edges when assembled. Also, the body receiving portion of the casket is of a fluid-tight construction.

DETAILED DESCRIPTION OF THE ILLUSTRATIVE EMBODIMENT

A. Body Receiving Portion

Figure 1:
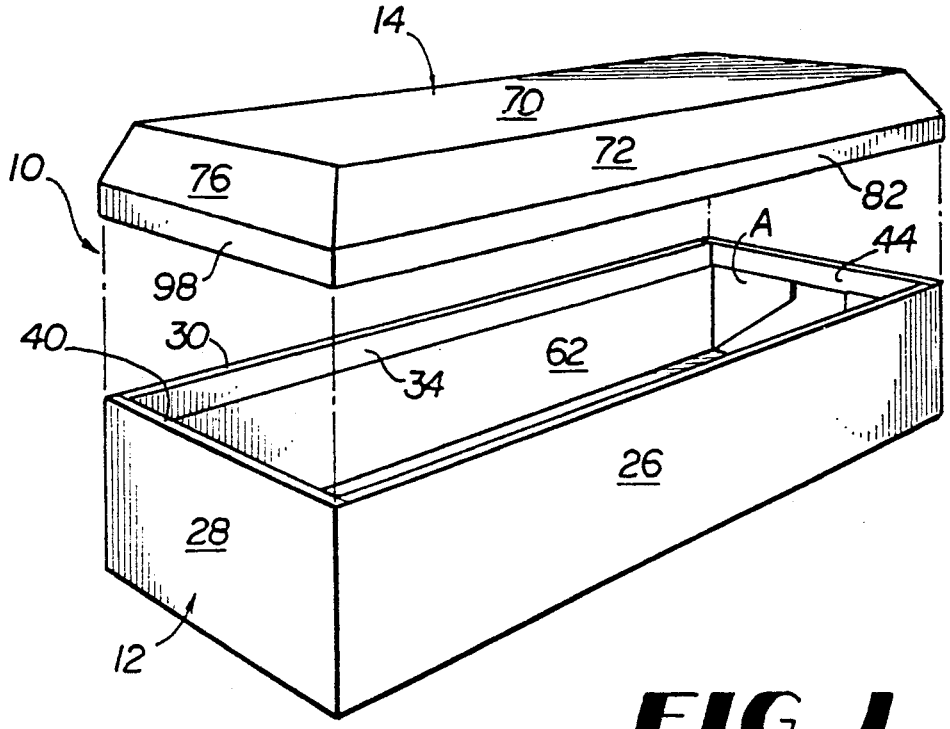
FIG. 1 is an exploded perspective view of the first embodiment of the present invention.
Figure 3:
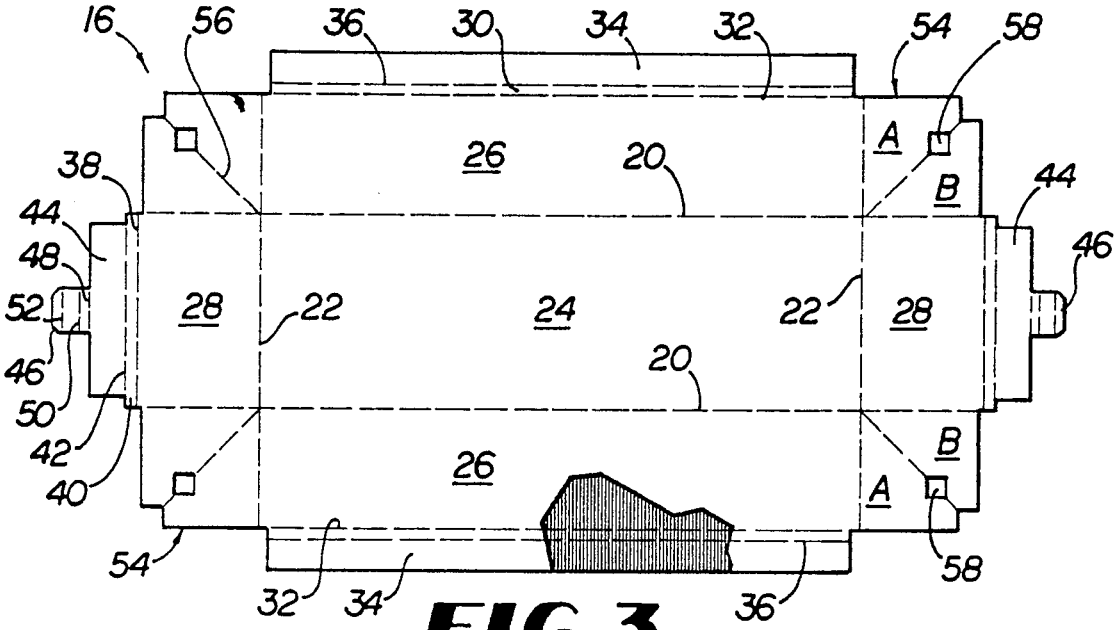
FIG. 3 is a top plan view of the blank of the outer section of the body receiving portion of the present invention.
Figure 4:
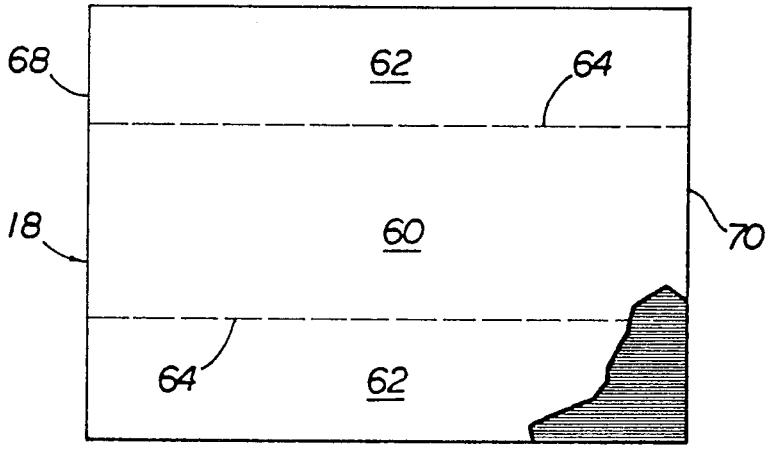
FIG. 4 is a top plan view of the blank of the inner section of the body receiving portion of the present invention.

The numeral 10 denotes generally an embodiment of the present invention shown in FIG. 1 comprising a body receiving portion 12 and a telescoping lid 14. Receiving portion 12 is rectangular in shape and, referring to the symmetrical blank therefor (FIG. 3), comprises an outer section 16 and an inner liner section 18 (FIG. 4). Outer section 16 is formed from a one-piece blank that includes folding lines 20 and 22 which border a rectangular central portion 24 that forms the bottom wall of the casket 10. Side walls 26 and end walls 28 are connected to central portion 24 along folding lines 20 and 22, respectively. Narrow, intermediate panels 30 are foldably joined to side wall sections 26 along fold lines 32. Outer edge panels 34 border intermediate panels 30 about fold lines 36.

The end walls 28 have upper fold edges 38 which are parallel to fold lines 22 and form the lower edge of medial panels 40 with fold edges 42 forming the upper edges thereof. Outer border sections 44 are foldably connected to fold edges 42 along their respective lower edges and include locking tabs 46 centrally projecting from their exterior, free edges about folding lines 48. Spaced, parallel folding lines 50, 52 laterally extend across the tabs 46.

Bellows-type corner sections 54 are formed by the lateral extensions from the ends of side walls 26 and end walls 28 and are delineated by the intersections of fold lines 20 and 22. Each of the corner sections 54 is comprised of equal-dimensioned, generally triangular-shaped web portions A, B, the hypotenuse of each forming a common fold line that extends at a 45° angle from the intersection of fold lines 20, 22. A small square opening 58 is formed in portions A, B so that its diagonal is coaxial with fold line 56. Portions A are connected to side walls 26 along fold line 22 and portions B are joined to end walls 28 through fold line 20.

Figure 5A:
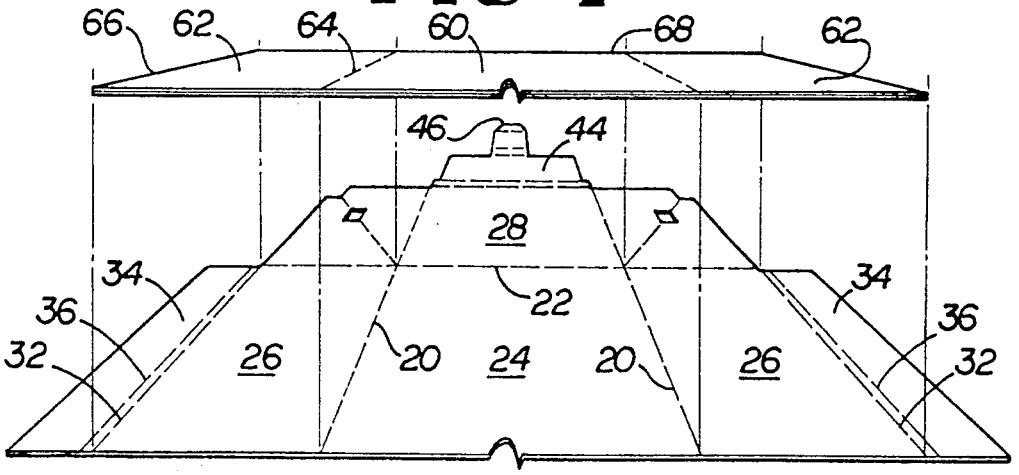
FIGS. 5A–5H are bird's-eye perspective views illustrating the erection of one-half of the body receiving portion, the other half being the mirror image thereof.

As seen in FIG. 4, inner liner section 18 is rectangular in shape having a main portion 60 that is joined to opposed side portions 62 along fold lines 64. Side portions 62 terminate in side edges 66 and end edges 68 (FIG. 5A). As shown, inner section 18 is of a double wall construction of corrugated material which has the fluting of each wall in alignment with each other.

Referring to FIG. 5A, the bottom of inner section 18 is dimensioned to overly and be bonded by any suitable glue or other bonding agent to the inner surface of outer section 16. More particularly, main portion 60 overlies central portion 24 and side portions 62 cover respective side walls 26. The side edges 66 and end edges 68 of inner section 18 are substantially coplanar with fold lines 32 and 22, respectively, and fold lines 64 are superimposed over fold lines 20. The fluting of the inner section 18 is transverse to the fluting of the outer section 16 to increase the stability of the erected structure.

Figure 5B:
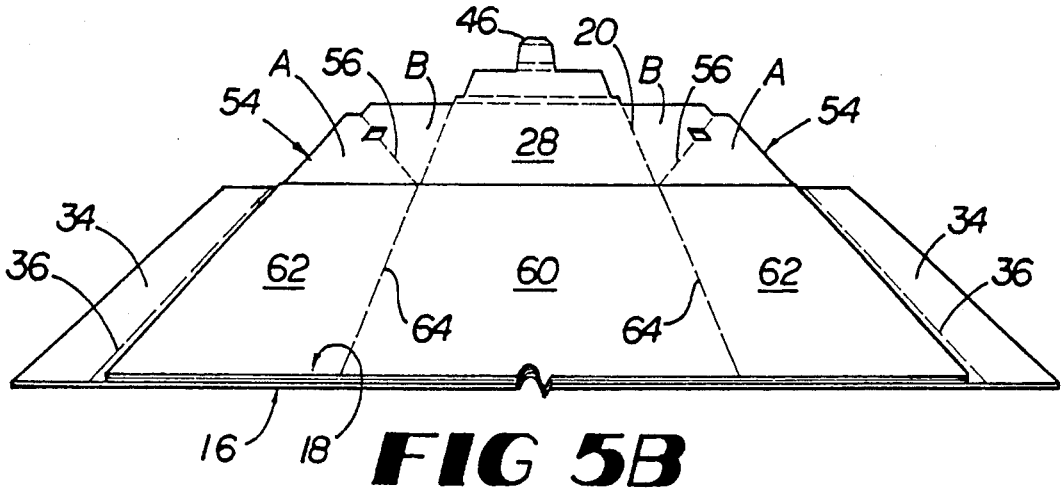
Figure 5C:
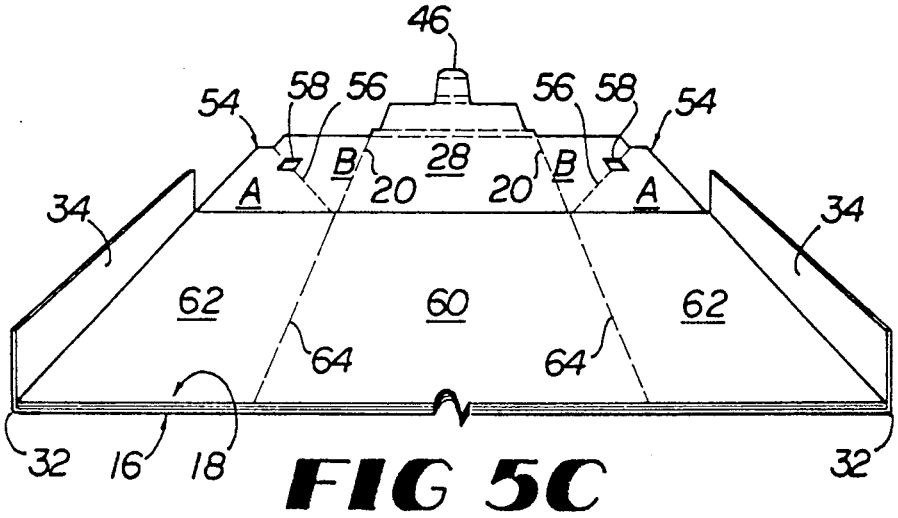
Figure 5D:
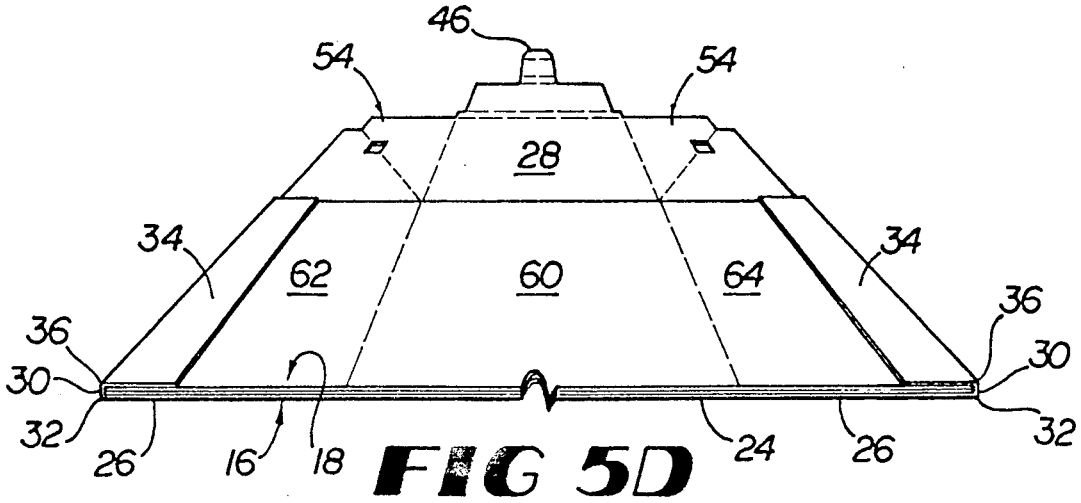

The set-up of the body receiving portion 12 is as follows: glue is applied by conventional means to the inner surface of the outer section 16. The bottom of inner liner section 18 is then placed into engagement with the inner surface of outer section 16 so that the respective components and associated fold lines are in registration, as discussed above. To ensure that the folding lines 20, 64 are in alignment, outer edge panels 34 are bent inwardly 180° about fold lines 32, 36 so that they are in bonding contact with the portions 64, as seen in FIGS. 5B–C. As a result of first folding inwardly the outer edge panels 34 90° about fold line 32 (FIG. 5C), the inner section 18 is properly seated upon outer section 16. The additional 90° bend of the outer edge panels 34 along fold line 36 (FIG. 5D) brings panels 34 into bonding engagement with the top surface of side portions 62.

Figure 5E:
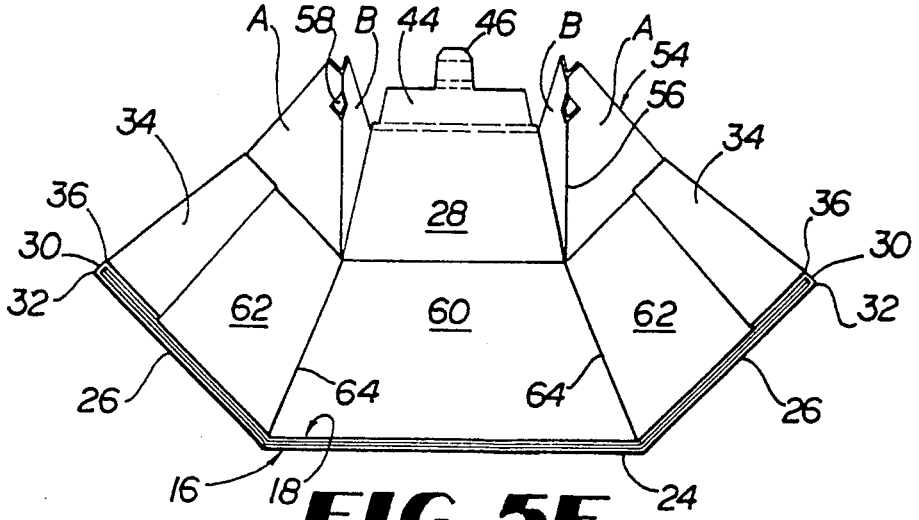
Figure 5F:
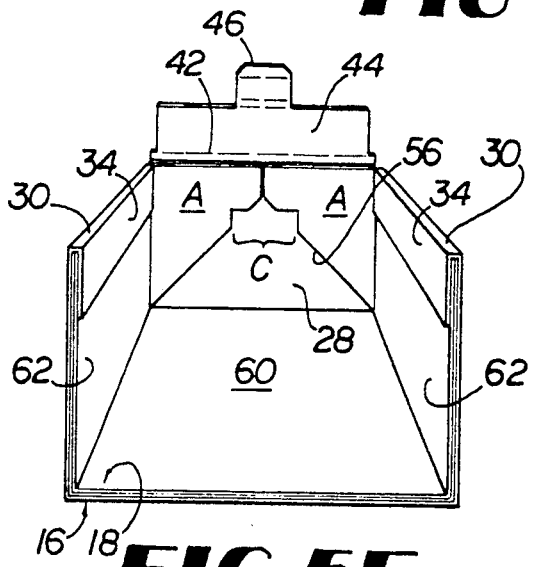
Figure 5G:
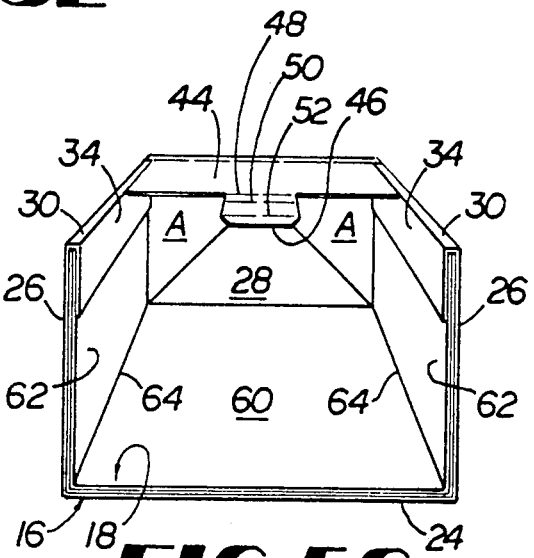

The next step of the set-up process for portion 12 is shown in FIGS. 5E and 5F and includes web elements A, B being folded inwardly along line 56 such that web B lies against end walls 28, leaving web A exposed. Simultaneously, end walls 28 are folded 90° about fold lines 22 (not shown in FIGS. 5E and 5F) and side walls 26 with side portions 62 glued thereupon are bent upright about respective fold lines 20 (also not shown in FIGS. 5E or FIG. 5F), 64. The body receiving portion 12 thereby assumes the configuration as shown in FIG. 5F.

Figure 5H:
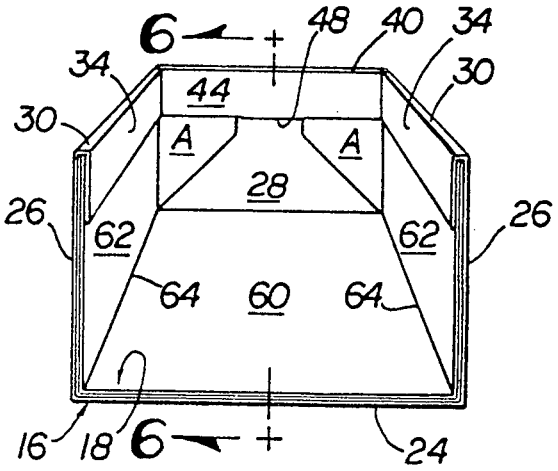
Figure 6:
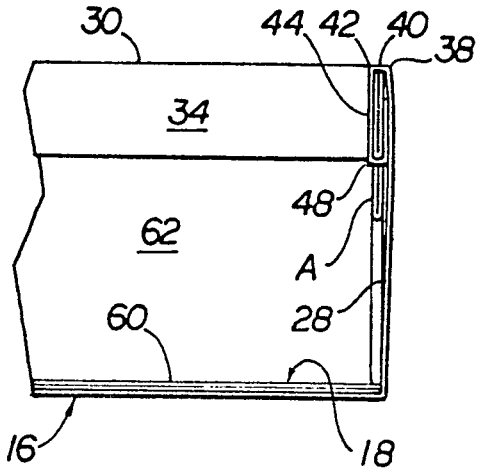
FIG. 6 is a view taken along line 6—6 in FIG. 5H.

The aperture C formed by the openings 58 when elements A and B are moved to their juxtaposed positions is sufficient to receive therein the locking tabs 46 as outer border sections 44 are first folded 90° along line 38 (FIG. 3) and are then brought into overlying engagement with web portions A by being bent along fold line 42. The locking tabs 46 are then successively folded inwardly about fold lines 48, 50, 52 so that they are secured out of view behind outer border sections 44 to maintain the end walls 28, and, thus, the bonded-together side walls 26 and side portions 62 in an erected condition. Medial panels 40 and intermediate panels 30 become the top surfaces of the ends and sides, respectively, of body receiving portion 12, thereby eliminating any exposed edges on the erected structure (FIG. 5H).

The exterior surfaces of side walls 26 and end walls 28 can have any suitable finish. For instance, a woodgrain appearance can be applied so as to more closely represent the wooden coffin that this invention replaces. Additionally, the interior of the body receiving portion 12 can be lined with any suitable material, such as a satin-like fabric. The preferred dimensions of portion 12 must obviously be sufficient to adequately receive therein a body. The inside dimensions of one embodiment are 6'4" (length)×22-½' (width)×13" (depth).

B. Lid of the First Embodiment

Figure 7:
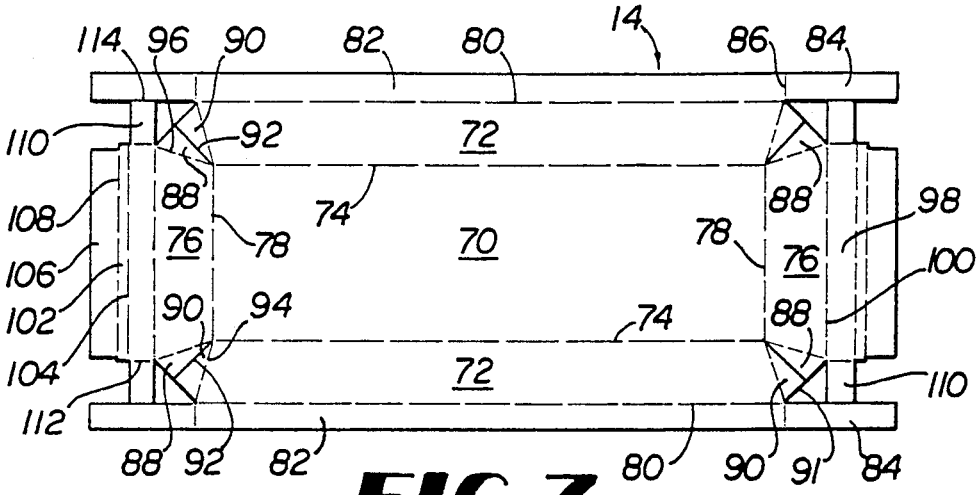
FIG. 7 is a top plan view of the blank of the first embodiment of the lid.

The blank for "full cover" lid 14 is shown in FIG. 7 and includes a rectangular central portion that forms the top panel 70 having equal shaped side sections 72 joined thereto along bend lines 74 and equal shaped end sections 76 connected thereto along bend lines 78. Each of the side sections 72 and end sections 76 have a trapezoidal shape. Joined along fold lines 80 to each of the side sections 72 is a side flap 82 which has a smaller dimensioned side panel 84 transversely extending from each of its ends about fold line 86. Each side panel 84 is of the same width as end panel 98 and one-half the length thereof.

A pair of triangular flaps 88, 90 form a gusset connection along common diagonal cut line 92 and are joined, along a respective hypotenuse, to side and end sections 72, 76 about bend lines 94, 96, respectively. End sections 76 have end panels 98 connected thereto about fold line 100. An intermediate panel 102 extends from end panels 98 along bend line 104 and is connected to end flaps 106 along bend line 108. Extensions 110 laterally project from the sides of end panels 98 into abutting engagement with side panels 84 and are foldably joined to panels 98 along lines 112. A cut line 114 separates each extension 110 from side panel 84.

Figure 8A:
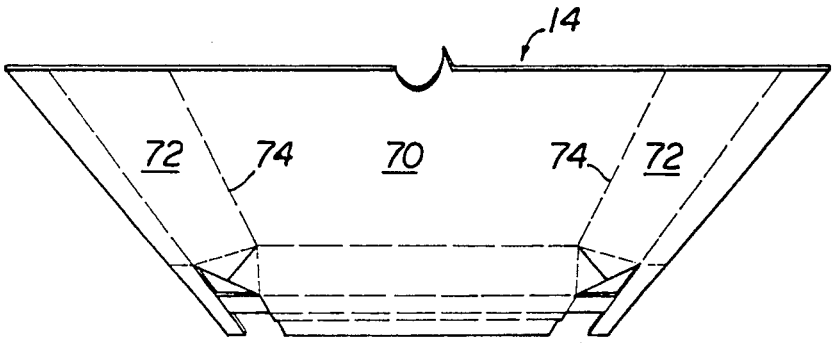
FIGS. 8A–8F are worm's-eye perspective views illustrating the folding of one-half of the lid blank of FIG. 7, the other half being the mirror image thereof.
Figure 8B:
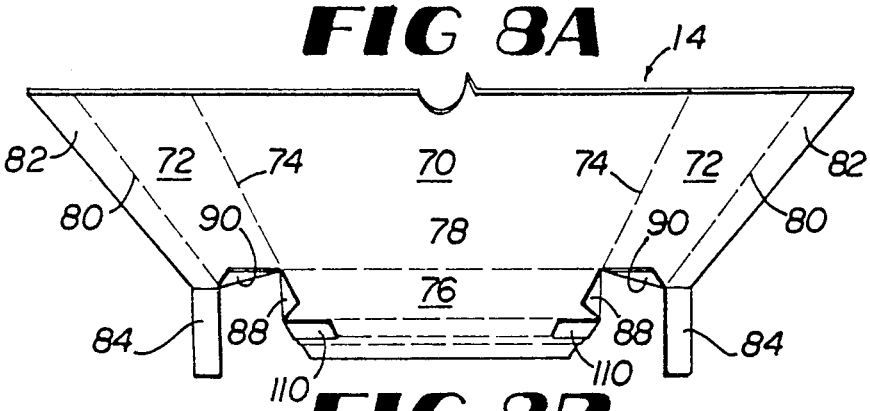
Figure 8C:
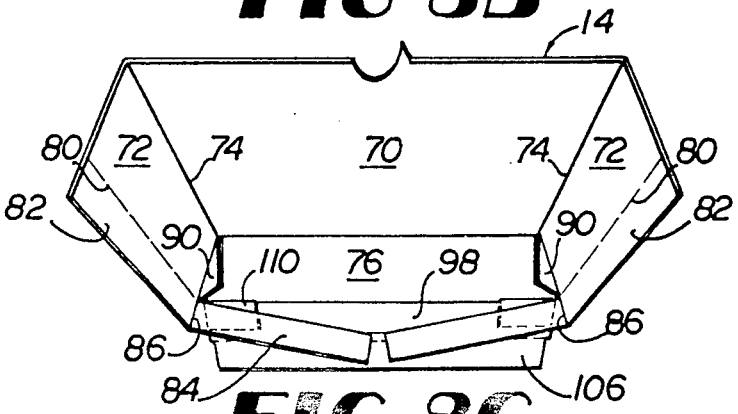
Figure 8D:
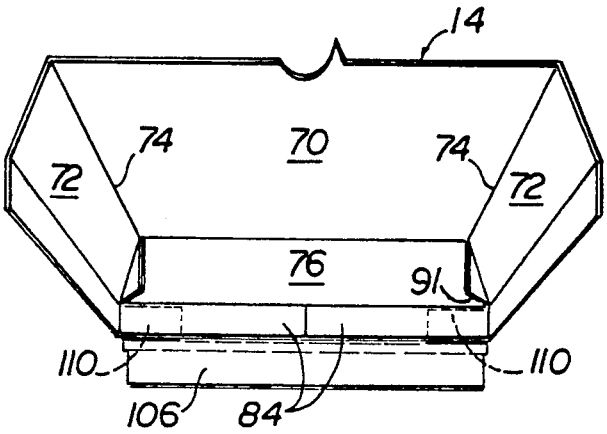

The erection of the blank lid 14 occurs as follows: as seen in FIGS. 8A and 8B, extensions 110 are severed along cut lines 114 from their connection to side panels 84 and are folded 180° about line 112 to lie against the inside surface of end panels 98. Flaps 88, 90 are separated along cut line 92 and bent 45° about lines 94, 96 towards end sections 76 and side sections 72, respectively. In FIG. 8C, end sections 76 are folded inwardly about fold line 78; side sections 72 with side flaps 82 are both folded inwardly about line 74; and side panels 84 are bent about lines 86 to overly extensions 110 and end panels 98. The lid 14 then assumes the shape as shown in FIG. 8D with flaps 88, 90 in a back-to-back relationship, jutting into the interior of lid 14 at a 45° angle from end sections 76 and side sections 72 and forming a bottom surface 91. Also, the positioning of side panels 84 as described causes side flaps 82 to be bent inwardly about line 80 so that they assume an orientation which is perpendicular to the top panel 70.

Figure 8E:
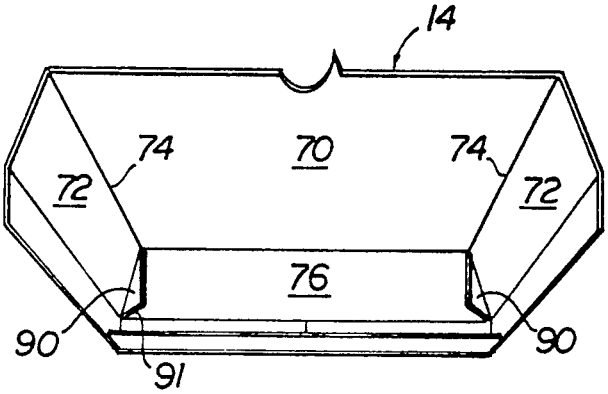
Figure 8F:
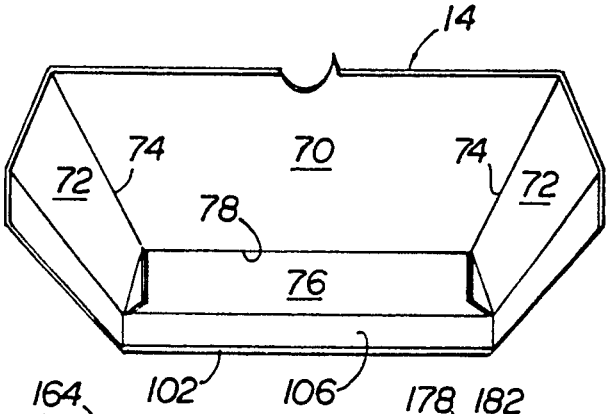

In FIGS. 8E and 8F, the final assembly of lid 14 is shown with end flap 106 being bent first 90° along line 108 and then another 90° along line 104 so as to overlap the side panels 84. A suitable adhesive may be placed on the interior surface of end flaps 106 so that they will bond to the side panels 84, thereby maintaining the lid 14 in an erected, tapered trapezoidal configuration with the end panels 98 being perpendicular to the top 70.

C. Lid of the Second Embodiment

Figure 2:
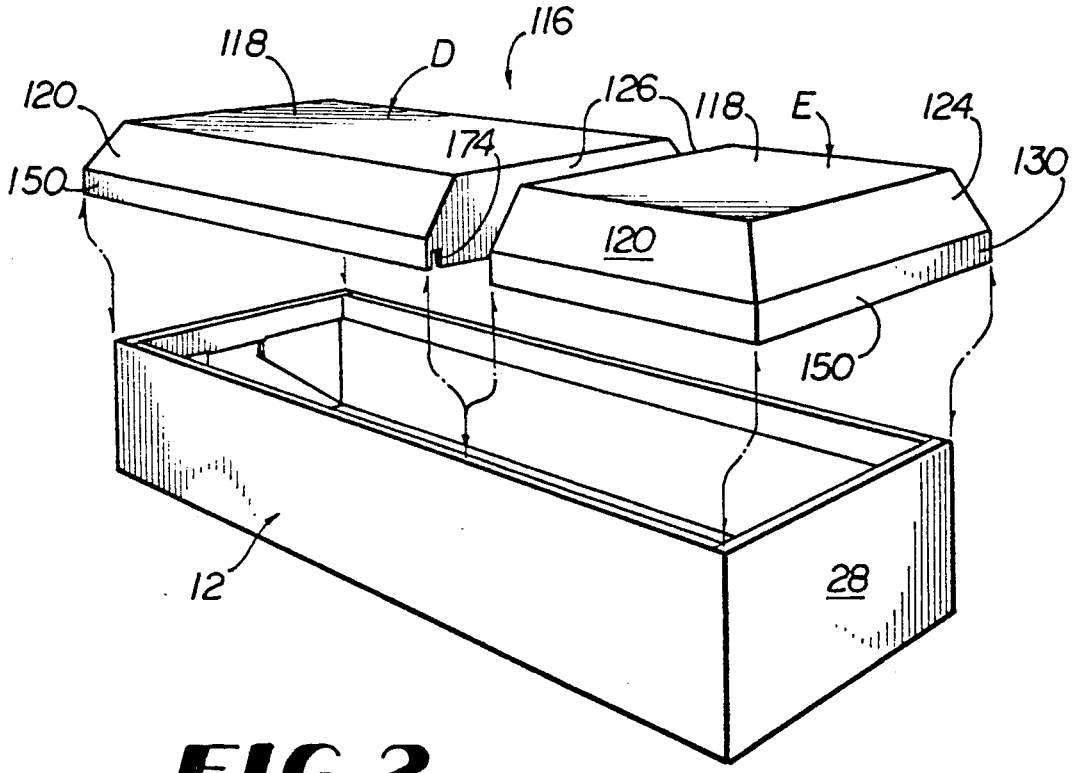
FIG. 2 is an exploded perspective view of the second embodiment of the present invention.
Figure 9:
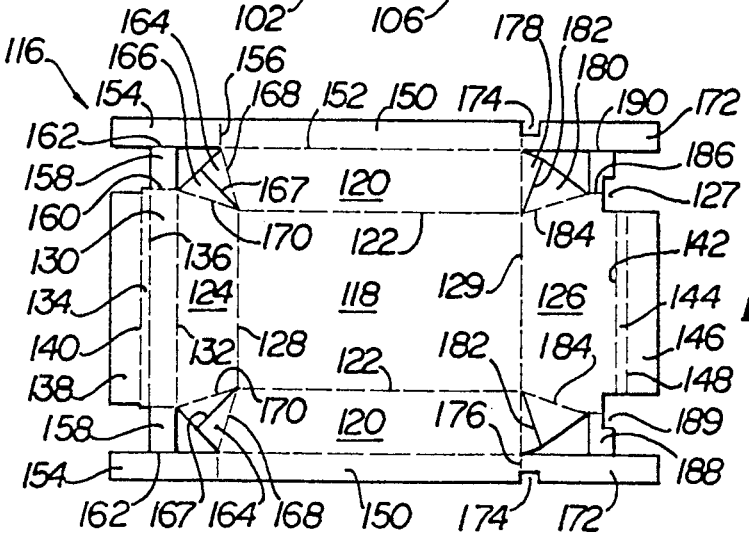
FIG. 9 is a top plan view of the blank of the second embodiment of the lid of the present invention.

FIG. 2 illustrates another embodiment of the present invention. The difference in the two embodiments relates to the respective lids. While lid 14 of the first embodiment is of a unitary construction, the lid 116 is comprised of two portions D and E, which are both formed from a blank having the same components as shown in FIG. 9. The only difference in the portions D and E is their length, with portion D being longer than portion E. When it is desired to view the upper torso of the deceased who is lying within the body receiving portion 12 during the cremation service, the E portion may be removed from the body receiving portion 12. At all other times, the portions D and E are in abutting engagement, covering the portion 12. Unlike the blanks shown in FIGS. 3 and 7, the blank in FIG. 9 is not symmetrical about a line laterally extending through its middle although it is symmetrical about its longitudinal axis.

The portions D and E are formed from a blank having a rectangular central section 118 (which becomes the top of the erected portions D and E) with trapezoidal side elements 120 joined thereto along fold lines 122 and a first trapezoidal end section 124 and a second trapezoidal end panel 126 being connected thereto along fold lines 128, 129, respectively. The right end edge of the side elements 120 in FIG. 9 are coincident with fold line 129. An end panel 130 is joined to end section 124 along fold line 132. The width of end 126 is equal to the sum of the widths of end panel 124 and intermediate panel 134. Intermediate panel 134 is joined to end panel 130 about fold line 136 and to first end flap 138 along fold line 140. Connected to end element 126 along fold line 142 is intermediate narrow portion 144 that is joined to second end flap 146 about fold line 148. The width of the second end section adjacent portion 144 is reduced to form a notch 127 on either end thereof.

Side flaps 150 are connected to side elements 120 along bend lines 152. Side panels 154 extend from one end of side flaps 150 along bend line 156. Extensions 158 project outwardly from the ends of end panel 130 along fold lines 160 and are joined to side panels 154 along cut lines 162. A pair of equal-dimensioned triangular flaps 164, 166 are joined to each other along cut line 167 and to a first end of side elements 120 and end section 124 along fold lines 168, 170, respectively. The fold lines 168, 170 are the hypotenuses of the respective flaps 164, 166.

Extending from the ends of side flaps 150 opposite side panels 154 are side extensions 172 having notches 174 formed in their bottom edges adjacent fold lines 176. Triangular-shaped web sections 178, 180 are unequal in size and have a common cut line 182 therebetween. Web section 180 is an equilateral triangle and web section 178 is an obtuse triangle. The web sections 178, 180 are respectively connected to side elements 120 and end element 126 along fold lines 129, 184, respectively. Laterally extending from end element 126 about fold lines 186 are notched elements 188 that are joined to side extensions 172 along cut lines 190. The notches 189 in elements 188, the notches 127 in the second end section 126 and the notches 174 in side extensions 172 are all of the same dimensions.

As noted above, the only difference between lid portions D, E is their length, with elements 118, 120 and 150 being longer in D than in E. The set-up of both portions D, E is the same, as follows:

Referring to FIG. 9, that part of either lid portions D, E which are to the left of fold line 128 is erected identically to that described above for the first embodiment (FIGS. 8A–F) and will not be described again. Therefore, referring to FIG. 2, the ends of portions D and E above end wall sections 28 of the body receiving portion 12 have the same configuration as either of the ends of lid 14.

Figure 10A:
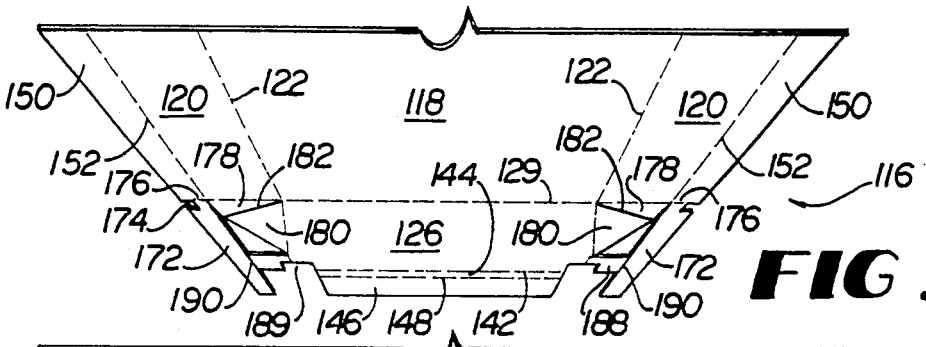
FIGS. 10A–10E are worm's-eye perspective views illustrating the folding of one-half of the lid blank of FIG. 9, the folding of the other half being identical to the lid shown in FIGS. 8A–8F.
Figure 10B:
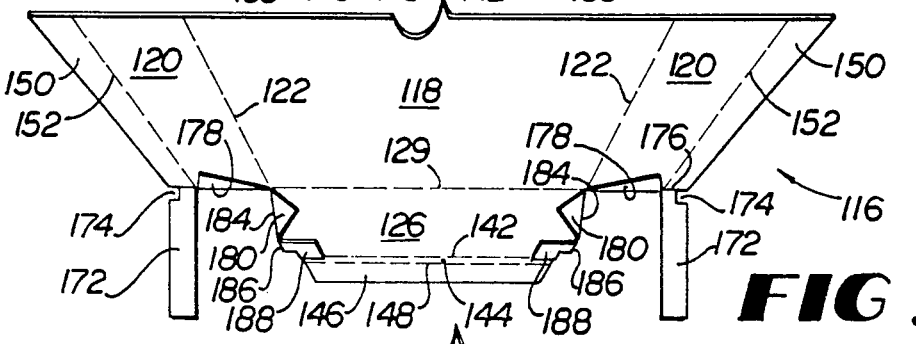
Figure 10C:
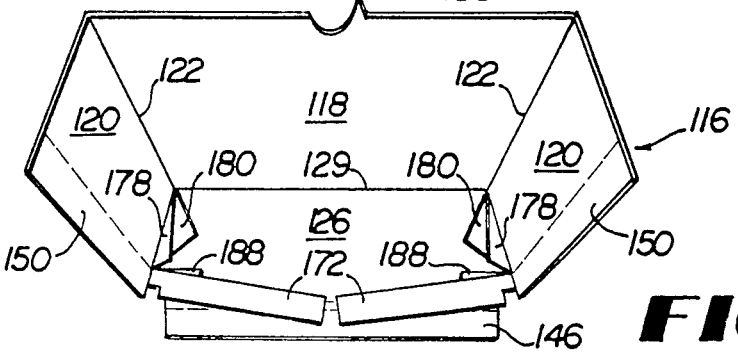
Figure 10D:
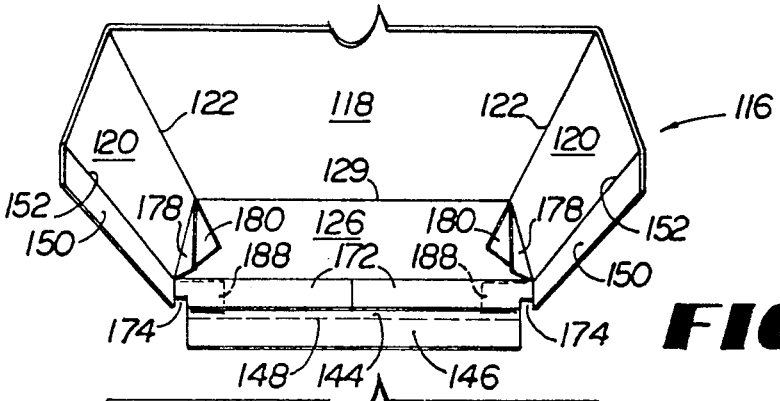
Figure 10E:
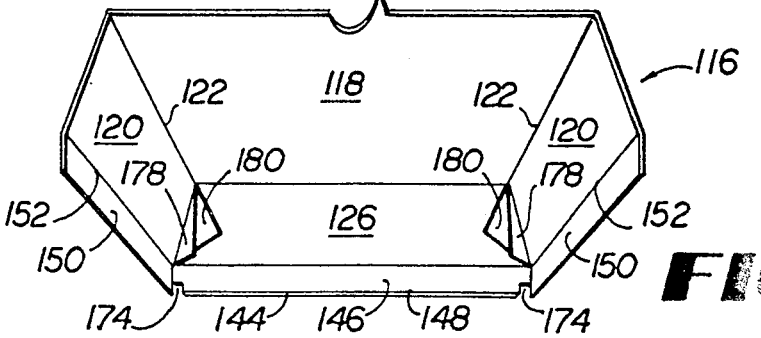
Figure 11:
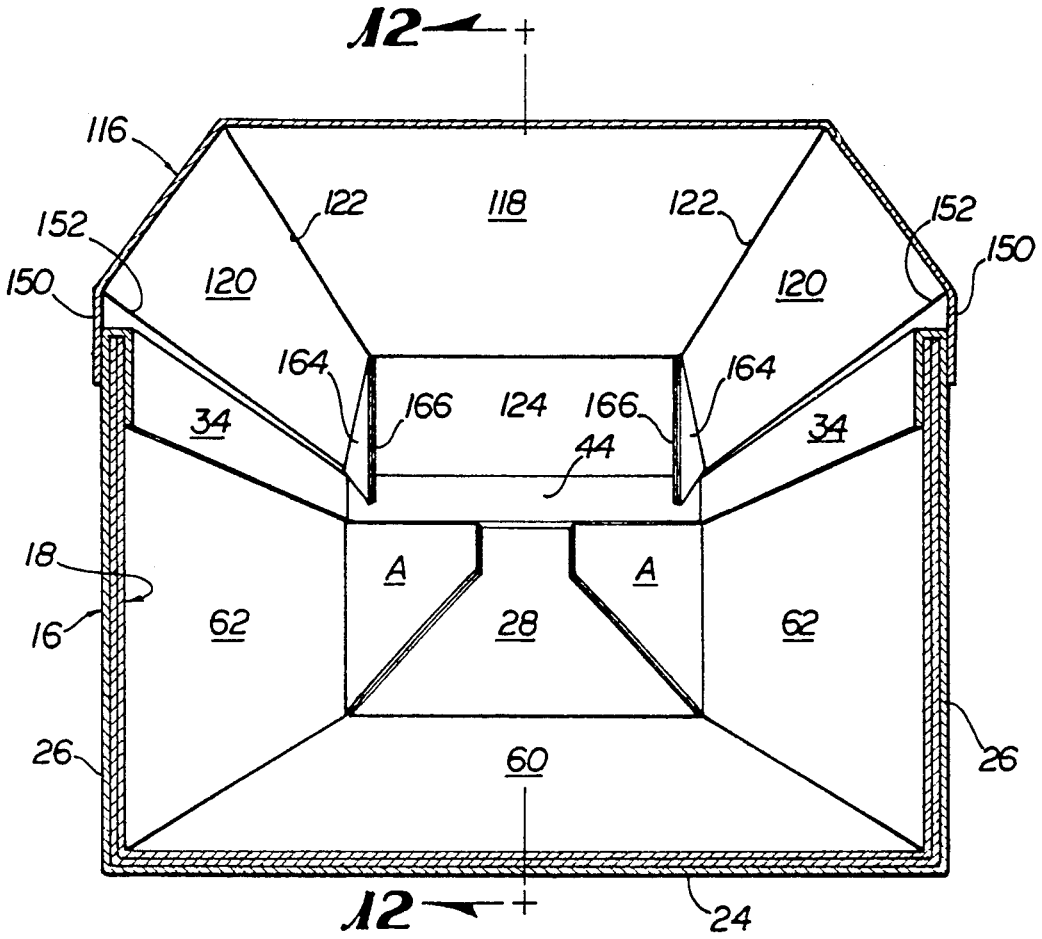
FIG. 11 is a perspective view through the middle towards one end of the assembled coffin of the second embodiment of the present invention.

FIGS. 10A–E show the set-up of the end of the lid opposite end section 124. Notched elements 188 are severed from side extensions 172 along lines 190 and are folded 180° about lines 186 to overlie end element 126, notches 189 overlapping the notches 127; web sections 178, 180 are severed along line 182, with sections 178 being folded about fold line 129 to engage side elements 120 and sections 180 being moved about lines 184 to overlie end element 126 (FIG. 10B). The end element 126 is folded inwardly along line 129, the side elements 120 are bent about fold lines 122 and side extensions 172 are brought in overlapping configuration with notched elements 188, causing side flaps 150 to bend inwardly approximately 45° along fold lines 152 (FIGS. 10C and 10D) with the notches 174 now overlying notches 189, 127. The end flap 146 is folded about lines 142, 148 to overlie side extensions 172. A suitable adhesive can be placed on the surface of end flap 146 which engages the side extensions 172 to maintain the lid portions D, E in an erected condition.

As seen in FIG. 2, the end element 126 presents a flat surface which is perpendicular to the top central section 118 so that the respective end elements 126 of portions D, E can be positioned in abutting relationship on the body receiving portion 12. The notch 174 in the end elements 126 of both portions D and E allow the respective end elements 126 to rest on the intermediate panels 30 so that section 118 can be maintained in a level, horizontal attitude. In that manner, the bottom edges of side flaps 150 and end panel 130 lie below the top surfaces of the body receiving portion 14 formed from intermediate panels 30 and medial panel 40.

Figure 12:
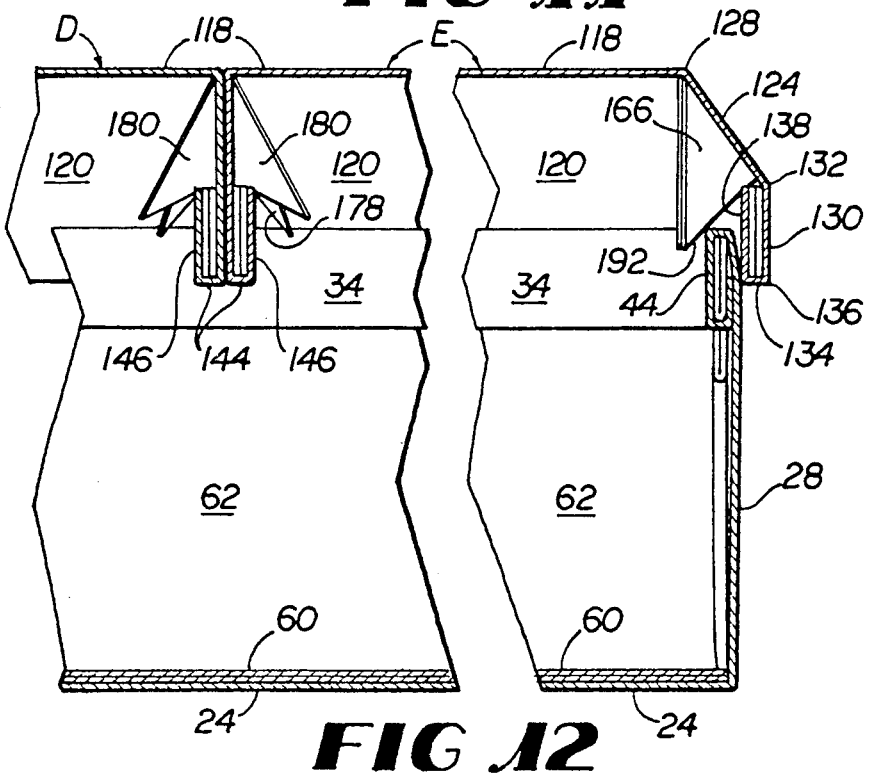
FIG. 12 is a view taken along line 12—12 in FIG. 11.

As seen in FIG. 12, the bottom surface 192 of flaps 164, 166 engages the corner formed by the junctive of intermediate panels 30 and medial panels 40 when lid portions D or E are placed on the body receiving portion 14. The profile view presented by end section 124 and end panel 130 on portion E as shown in FIG. 2 is the same as on the end of portion D which is not shown in FIG. 2. Of course, it is understood that the lid 14 and lid portions D, E can have any desirable shape.

As seen most clearly in FIGS. 1 and 2, the assembled coffin, including the respective lid(s), provides a finished appearance, with no corrugated cardboard being visible. Also, the body-receiving portion is liquid tight. Thus, the present invention presents a viable alternative for traditional wooden caskets in cremation ceremonies.

What I claim is:

1. A corrugated paper casket comprising: a lower body receiving portion having an outer section and an inner liner section, the outer section comprising:

(a) a rectangular central portion that forms the bottom of the casket;

(b) opposed sides and opposed end walls foldably joined to the central portion along respective sides and ends of the central portion;

(c) a pair of outer edge panels of approximately the same length as that of the side walls;

(d) a pair of intermediate panels foldably interconnecting the side walls and a respective one of the edge panels along the opposed longitudinal edges of the intermediate panels;

(e) a pair of outer border sections of approximately the same length as the end walls;

(f) a pair of medial panels foldably interconnecting the end walls and a respective one of the outer border sections along the opposed longitudinal edges of the medial panels;

(g) a locking tab laterally projecting along a fold line from the free side of each of the outer border sections;

(h) a corner section formed at an intersection of each end of the end walls and the side walls, each corner section comprising a pair of generally triangular-shaped portions, the hypotenuse of each portion forming a common fold line that extends at a 45° angle from the intersection, each triangular-shaped portion foldably joined to an end of the end wall and the side wall and the corner sections having a rectangular opening therethrough with the diagonal of the opening coaxial with the common fold line; and the inner liner section comprising:

(i) a main portion which is of the same dimensions as the central portion of the body receiving portion; and (j) a pair of side portions foldably joined to corresponding sides of the main portion, each of the side portions having the same dimensions as each of the side walls of the body receiving portion, the main portion and side portions overlying in abutting engagement the central portion and the side walls, respectively, with the outer edge panels being folded 180° to overlap at least a portion of the respective side portion, the joined-together side portions and side walls being folded inwardly 90°, the end walls being folded inwardly 90°, the triangular-shaped portions being folded inwardly about their fold lines the rest in juxtaposed position against the end walls, the locking tabs being folded inwardly to be received within the apertures formed by a pair of openings in adjacent folded triangular-shaped portions, and the intermediate and medial panels thereby becoming the top surfaces of the erected lower body receiving portion and further comprising a first lid for telescoping engagement with the lower body portion, the first lid comprising:

(k) a rectangular-shaped central section which forms the top of the lid;

(l) a pair of trapezoidal side elements foldably joined along respective first sides thereof to opposed sides of the central section;

(m) a first trapezoidal end section foldably joined about a side thereof to a first end of the central portion;

(n) an end panel foldably connected to the first end section about an opposite side of the first end section;

(o) a first end flap;

(p) an intermediate panel foldably joining along respective sides thereof the end panel and the first end flap;

(q) a second trapezoidal end section foldably joined to the central portion about the second end opposite the first end, the width of the second end section being the sum of the widths of the first end section and the end panel;

(r) a second end flap;

(s) an intermediate portion foldably joining along respective sides thereof the second end section and the second end flap, the second end section having a pair of opposed openings in the end thereof adjacent the intermediate portion;

(t) a pair of equal-dimensioned, right-triangular flaps formed at the intersection of the ends of the first end section and a first end of each of the side elements and joined to each other along a common cut line, the hypotenuse of each flap being coincident with a fold line connecting the flap to a respective side element or the first end section;

(u) a pair of unequal-dimensioned, triangular-shaped web sections formed at the intersection of the ends of the second section and the second end of each of the side elements opposite the first end thereof, and joined to each along a common cut line;

(v) a pair of side flaps foldably joined to the side elements along the sides opposite to the first sides of the side elements;

(w) a pair of side panels extending from and foldably joined to the first end of each of the side flaps adjacent the first end section;

(x) a pair of side extensions extending from and joined to the second end of each of the side flaps along a fold line, the side extensions having an opening formed in their bottom edges adjacent the respective fold lines;

the right triangular flaps and the web sections being separated along respective cut lines thereof and folded inwardly, the first end section being bent inwardly 45° to the central section, the side panels being folded inwardly to overly the end panel which is folded 90° to the first end section, the second end section being bent 90° to the central portion and the side extensions being folded inwardly to overly the second end section with the openings in the side extensions overlying the openings in the second end section, the side elements being folded 45° to the central section and the side flaps being folded 90° to the side elements, the first end flap being folded inwardly 180° to overly the side panels and the second end flap being folded inwardly 180° to overly the side extensions, whereby the top edges of the sides of the body receiving portion engage the openings thereby formed in the bottom of the second end section when the lid is telescopically received on the body receiving portion so that the bottom edges of the side flaps, the second end section and the end panel are below the top edges of the body receiving portion.

2. A casket as claimed in claim 1 and further comprising a second lid for telescoping engagement with the lower body portion having the construction of the first lid with the central section, the side elements and the side flaps of the first lid being of a different length than the central section, the side elements and the side flaps of the second lid, whereby the second end sections of the first and second lids are in abutting engagement when the first and second lids are on the body receiving portion.

3. A lid for being telescopically received on a rectangular-shaped, paperboard body receiving portion of a casket having top edges on the sides and end walls thereof, comprising a first portion of a first length having:

(a) a rectangular top portion;

(b) a pair of opposed side walls depending from the rectangular top portion and having bottom edges;

(c) a first end wall interconnecting a first end of the side walls and the top portion and having a bottom edge;

(d) a second end wall interconnecting a second end of the side walls and the top portion and having a bottom edge, the second end wall being in opposed relationship to the first end wall and being flat and in a plane which is perpendicular to the top portion, the second end wall having a bottom edge and a pair of notches therein adjacent the juncture of each of the side walls and the second end wall so that when the lid portion is telescopically received on the body receiving portion, the top edges of the sides of the body receiving portion are received within the notches to allow the bottom edges of the side walls, the first end wall and the second end wall to be below the top edges.

4. A lid as claimed in claim 3 and wherein the lid further comprises a second portion of a second length and having the construction of the first portion, wherein the second portion is telescopically received on the body receiving portion such that the second end of the second portion is in abutting engagement with the second end of the first portion and the first ends of first and second portions being at the opposed ends of the body receiving portion.

5. A lid as claimed in claim 3 wherein the first length is different than the second length.

6. A corrugated paper casket, comprising:

(a) a rectangular-shaped body receiving portion having side and end walls and top edges therealong; and (b) a lid for telescoping engagement with the body receiving portion, the lid comprising:

(1) a rectangular-shaped central portion which forms the top of the lid;

(2) a pair of equal-shaped, trapezoidal side sections and a pair of equal-shaped, trapezoidal end sections foldably joined to the central portion along corresponding edges thereof;

(3) a rectangular-shaped side flap foldably joined to a respective edge of each of the side sections;

(4) a rectangular-shaped end panel foldably joined along an edge of the end section;

(5) a pair of triangular flaps with the hypotenuse of one flap foldably connected to an end of each end section and with the hypotenuse of the second flap foldably joined to an end of each side section, a cut line diagonally extending between each of the pairs of flaps; and (6) means for interconnecting adjacent ends of the side flaps and said end panels to form angles of 90°, whereby adjacent ones of the trapezoidal sections are disposed with their respective ends substantially in contact so that each of the pairs of triangular flaps are located in face contact and extend inwardly of the lid to support the lid on the top edges of the lower body receiving portion.

7. A lid for being telescopically received on a rectangular-shaped, paperboard body receiving portion of a casket having top edges on the sides and end walls thereof, the lid comprising:

(a) a rectangular-shaped central portion which forms the top of the lid;

(b) a pair of equal-shaped, trapezoidal side sections and a pair of equal-shaped, trapezoidal end sections foldably joined to the central portion along corresponding edges thereof;

(c) a rectangular-shaped side flap foldably joined to a respective edge of each of the side sections;

(d) a rectangular-shaped end panel foldably joined along an edge of the end section;

(e) a pair of triangular flaps with the hypotenuse of one flap foldably connected to an end of each end section and with the hypotenuse of the second flap foldably joined to an end of each side section, a cut line diagonally extending between each of the pairs of flaps; and (f) means for interconnecting adjacent ends of the side flaps and the end panels to form angles of 90°, whereby adjacent ones of such trapezoidal sections are disposed with their respective ends substantially in contact so that each of the pairs of triangular flaps are located in face contact and extend inwardly of the lid to support the lid on the top edges of the lower body receiving portion.

* * * * *